US010709232B1

(12) United States Patent
Sagastume

(10) Patent No.: US 10,709,232 B1
(45) Date of Patent: Jul. 14, 2020

(54) PAINT BRUSH WITH A ROTATABLE SCRAPER AND COMFORTABLE GRIP

(71) Applicant: Mario F. Sagastume, Pembroke Pines, FL (US)

(72) Inventor: Mario F. Sagastume, Pembroke Pines, FL (US)

( * ) Notice: Subject to any disclaimer, the term of this patent is extended or adjusted under 35 U.S.C. 154(b) by 72 days.

(21) Appl. No.: 16/032,186

(22) Filed: Jul. 11, 2018

(51) Int. Cl.
*B05C 17/00* (2006.01)
*A46B 15/00* (2006.01)
*B44D 3/16* (2006.01)

(52) U.S. Cl.
CPC ..... *A46B 15/0081* (2013.01); *B44D 3/164* (2013.01); *A46B 2200/202* (2013.01); *B05C 17/00* (2013.01)

(58) Field of Classification Search
CPC ..... A46B 13/02; A46B 15/0081; B44D 3/164
See application file for complete search history.

(56) References Cited

U.S. PATENT DOCUMENTS 1,382,042 A * 6/1921 Wright ..... A46B 9/08 15/169
2008/0086829 A1* 4/2008 Adams ..... A63C 11/08 15/236.01
2011/0138566 A1* 6/2011 Wang ..... A47L 13/08 15/236.01

* cited by examiner

*Primary Examiner* — Michael D Jennings
(74) *Attorney, Agent, or Firm* — Malin Haley DiMaggio & Bowen, P.A.

(57) ABSTRACT

A paintbrush having an elongated handle with brush bristles connected to the proximal end of said handle and a rotatable paint scraper attached to the distal end of said elongated paintbrush handle so that the scraper can be deployed from the brush handle by a user. The paintbrush handle also includes a magnet on one side for attaching the paintbrush and hanging the paintbrush from a metal surface such as a paint can when not in use or temporarily during work breaks. The rotatable paint scraper blade can be moved by depressing and operating button to move the blade away from the paintbrush handle sufficiently to allow 180° rotation from an operable position extending away from the distal end of the paintbrush handle to a storage position snugly against the paint brush handle.

3 Claims, 3 Drawing Sheets

PAINT BRUSH WITH A ROTATABLE SCRAPER AND COMFORTABLE GRIP

BACKGROUND OF THE INVENTION

1. Field of the Invention

A paint brush that includes a handle having an ergonomic recessed shaft area for receiving a thumb or finger, bristles extending from a proximal end, a rotatable paint scraper attached near the distal end of the paint brush handle, and a support magnet on the scraper to hang the brush.

2. Description of Related Art

A surface to be painted with a handheld brush needs to be properly prepared prior to applying paint to the surface. One task required is to scrape the surface to be painted with a rigid scraper in order to properly ensure that the surface is ready to be painted. It is a benefit to the user to have a paint brush that includes a paint scraper that is readily deployable and storable while attached to the paintbrush itself.

Hand painting with a hand brush can be manually stressful on the arm and hand muscles. Therefore it is important that gripping the brush with a hand is as comfortable as possible, considering the action that is required in applying paint to a surface with a hand brush. In the invention described herein, the paint brush handle shaft includes recessed areas to improve the comfort of the user's hand gripping the paintbrush during the painting operation manually.

It is also desirable to store the brush, either temporarily or permanently, against a metal surface so that the brush and bristles can hang downwardly for drying. In accordance with the invention, the paint brush includes a magnet attached on the scraper near the distal end on one side of the handle to allow the entire paint brush to be mounted on a metal surface, vertically using a magnet.

SUMMARY OF THE INVENTION

A handheld paint brush having a proximal end attached to a plurality of bristles, an elongated handle body and a distal end that includes a rotatable paint scraper, said scraper having an extended operable blade positioned parallel to the handle body longitudinal axis, said blade extending outwardly from the distal end of the handle and said blade having a storage position parallel to the handle body.

The handle body also includes one or more shallow, recessed elliptical areas for receiving the thumb or finger of a brush user to enhance the comfort of the grip. The paint scraper is mounted on a cylindrical shaft through the body of the brush near the distal brush end. The rotatable scraper blade is operated by an operating convex button attached to one end of the scraper cylindrical shaft along with a locking spring disposed on one side of the paint brush handle. The paint scraping blade is attached to the other end of the cylindrical shaft along with a washer. The handle body is diminished in thickness in the area occupied by the paint scraper blade so that the blade can rest flush with the handle body in the storage position.

In order to deploy or extend the paint scraper blade to its operable position extending outwardly from the distal end of the paintbrush handle, the user depresses the operating button against the spring tension toward the handle, thus raising the scraper blade above the surface of the brush handle to an extent that then allows rotation of the scraper blade from the stored position, flush with the brush handle surface, to the extended position, extending outwardly from the distal brush handle end.

The brush handle has a cylindrical channel or passage all the way through that receives the scraper cylindrical shaft that operates the scraper blade. The cylindrical channel on one side includes a circular locking washer that has two raised tabs diametrically opposed on one side of said locking washer that engage indented areas on each side of said scraper blade to lock the blade in place when extended in the operable position and to lock the blade in place when the blade is stored flush with the brush handle surface.

The scraper blade can be rotated by rotating the operating button that is fixed to the cylindrical shaft as is the scraper blade so that all the components rotate together. The lock washer remains fixed in position as attached to the paintbrush handle channel. A washer is attached to the cylindrical shaft next to the scraper blade to support the attachment of the scraper blade to the cylindrical shaft.

A magnet is attached at the end of the cylindrical shaft and washer connection near the scraper blade. The magnet can be used to hang the entire paintbrush vertically from a metal surface or a paint can.

It is an object of this invention to provide an improved handheld paintbrush that includes a deployable rotatable paint scraper that can extend from the end of the paintbrush handle.

It is another object of the invention to provide an improved handheld paintbrush that includes a brush body having shallow recessed areas, elliptically shaped, to receive the thumb or finger of a user to improve the grip comfort of the brush handle during use.

It is yet another object of the invention to provide an improved handheld paintbrush that includes a deployable paint scraper and recessed thumb comfort area in addition to a magnet that can be used to hang the paintbrush vertically from a metal surface including a paint can.

DESCRIPTION OF A PREFERRED EMBODIMENT OF THE INVENTION

Figure 1:
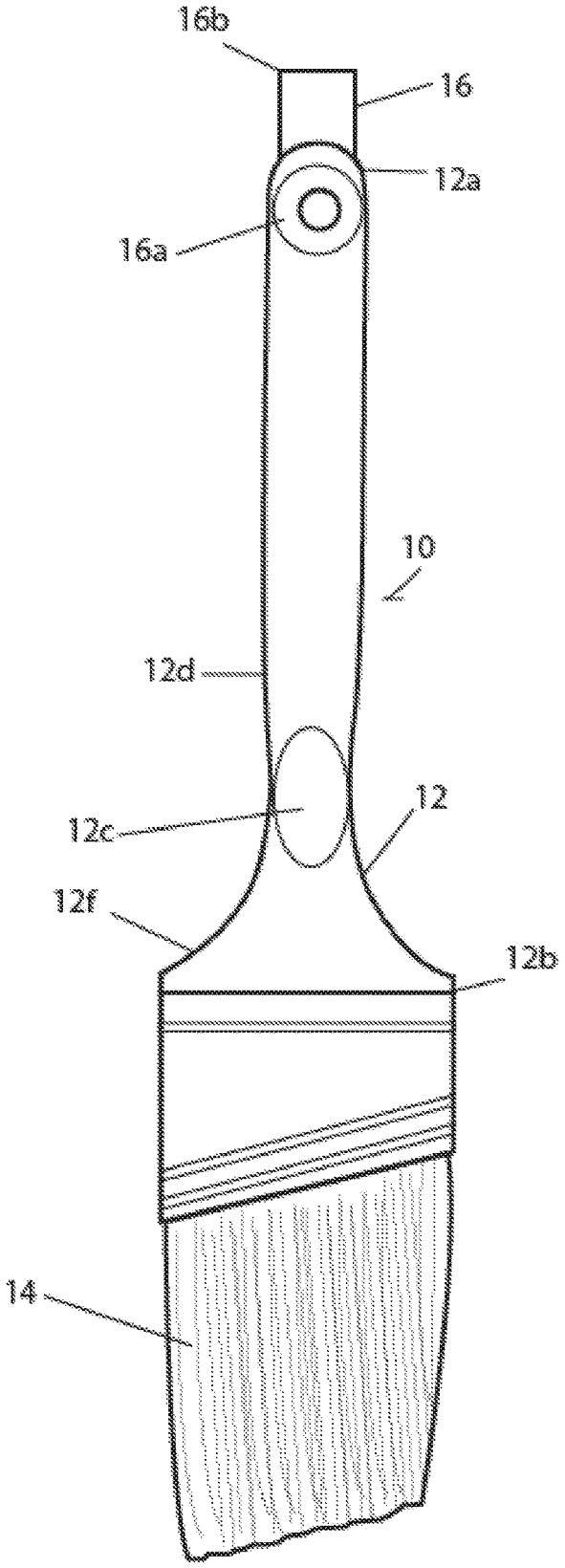
FIG. 1 is a front elevational view of the paint brush with the scraper blade extended to the operating position.
Figure 2:
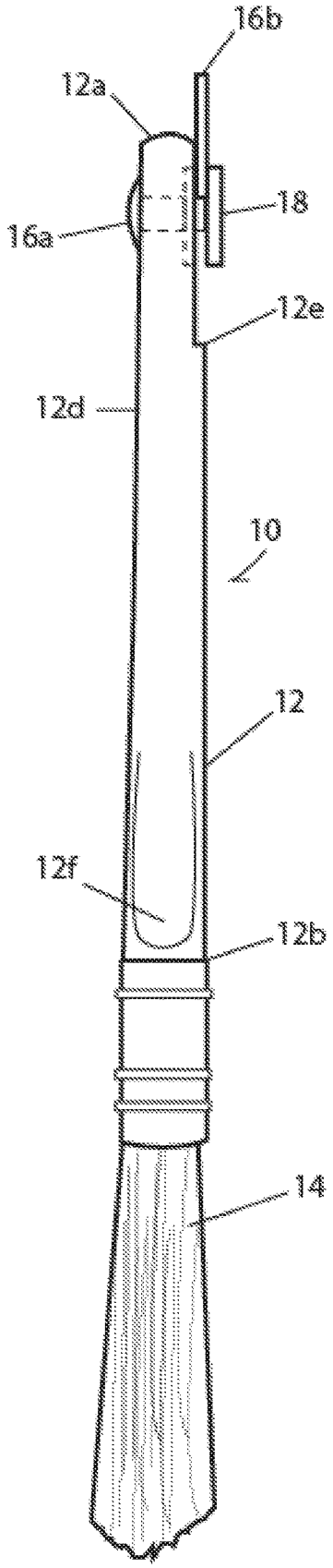
FIG. 2 is a side elevational view of the paintbrush shown in FIG. 1.

Referring now to the drawings and especially FIG. 1 and FIG. 2, a paintbrush 10 is shown having a handle 12 attached to bristles 14 at its proximal end 12*b* and a paint scraper 16 rotatably attached near the distal end 12*a*. The handle 12 is often made of wood or rigid plastic. The handle 12 also includes elliptically-shaped recess 12*c* that is shallow and shaped and sized to receive the thumb or finger of a user grasping the paintbrush handle. This is for comfort to prevent muscle strain during painting.

The paint scraper 16 also includes a control button 16*a* that is attached to a shaft through the distal end 12*a* of the paintbrush handle to the scraper blade 16*b* and to a central shaft described below. As shown in FIG. 2, a magnet 18 is attached to the scraper blade 16*b*.

The paintbrush handle 12 includes a recessed portion from handle ledge 12*e* (FIG. 2) upward toward the distal end 12*a* which allows rotation 180° of the scraper blade 16*b* from an operating position as shown in FIG. 2, extended vertically from the paintbrush handle distal end 12*a* to a stored position flush with the paintbrush handle.

Referring now to FIG. 3, the distal end of the paintbrush handle 12*a* is shown having a paint scraper 16 rotatably attached thereto. Paint scraper blade 16*b* is shown extended vertically upwardly away from the distal brush handle distal end 12*a* in the operating position. In the storage position, the blade 12*b* would be rotated 180° so that the blade edge is adjacent paintbrush handle 12*e* ledge and the blade 16*b* is flush with the paintbrush handle body.

Figure 3A:
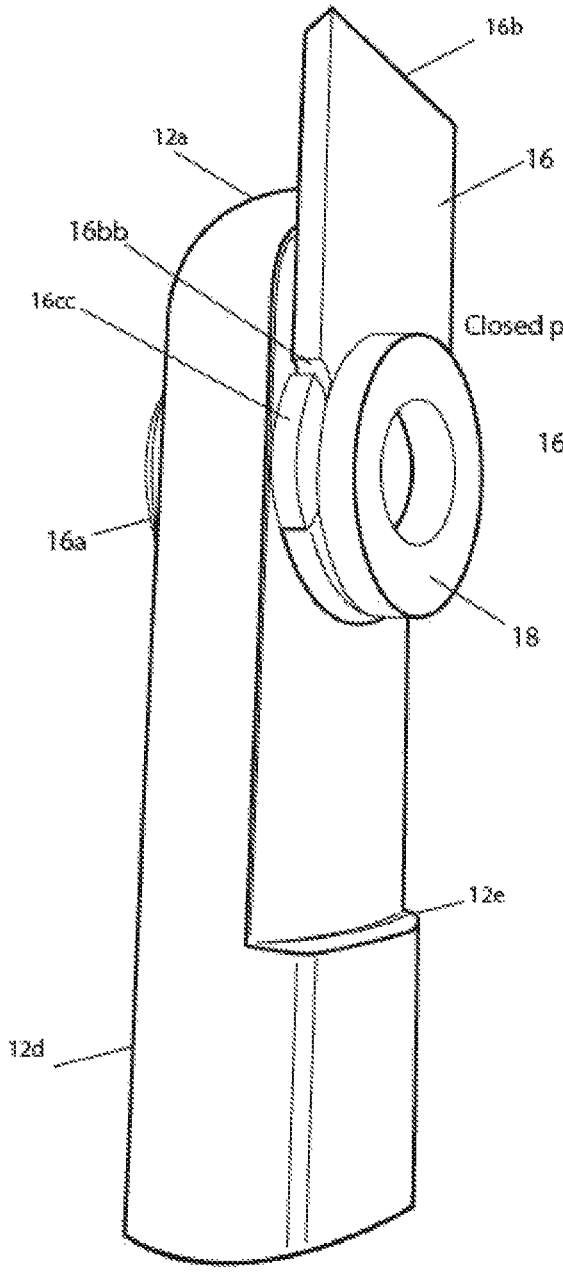
FIG. 3A and FIG. 3B show respective partially cutaway views of the paintbrush handle distal ends with the blade closed (locked in place) and open (rotatable) respectively and a magnet attached thereto.
Figure 3B:
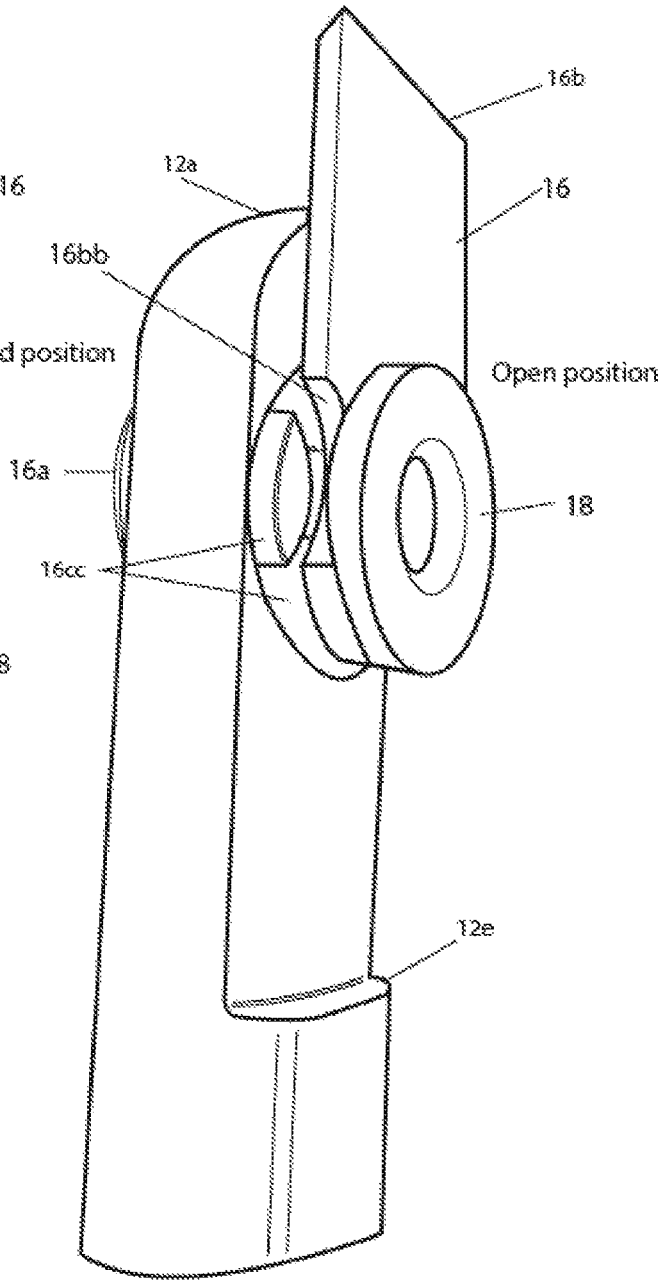

Scraper blade 16*b* has a double locked position, the first being the operating position as shown in FIG. 3A, and a second locked position being the storage position (not shown). FIG. 3B shows blade 16 elevated above washer and blade locking member 16*cc* outside of slot 16*bb* so that the blade can rotate when elevated as open. A circular blade locking member 16*cc* is attached within a socket of the paintbrush handle and does not rotate.

The blade lock 16*c* includes a pair of opposing blade locking members 16*cc* that fit into a slot 16*bb* on each side of the blade (180 degrees apart). Manually depressing operating button 16*a* causes blade 16 to move away from the paintbrush handle 12 and rise above the blade locking member 16*cc* allowing the blade 16*b* to be rotated 180 degrees to the storage position against a spring, not shown in FIG. 3 A or FIG. 3B.

Figure 4:
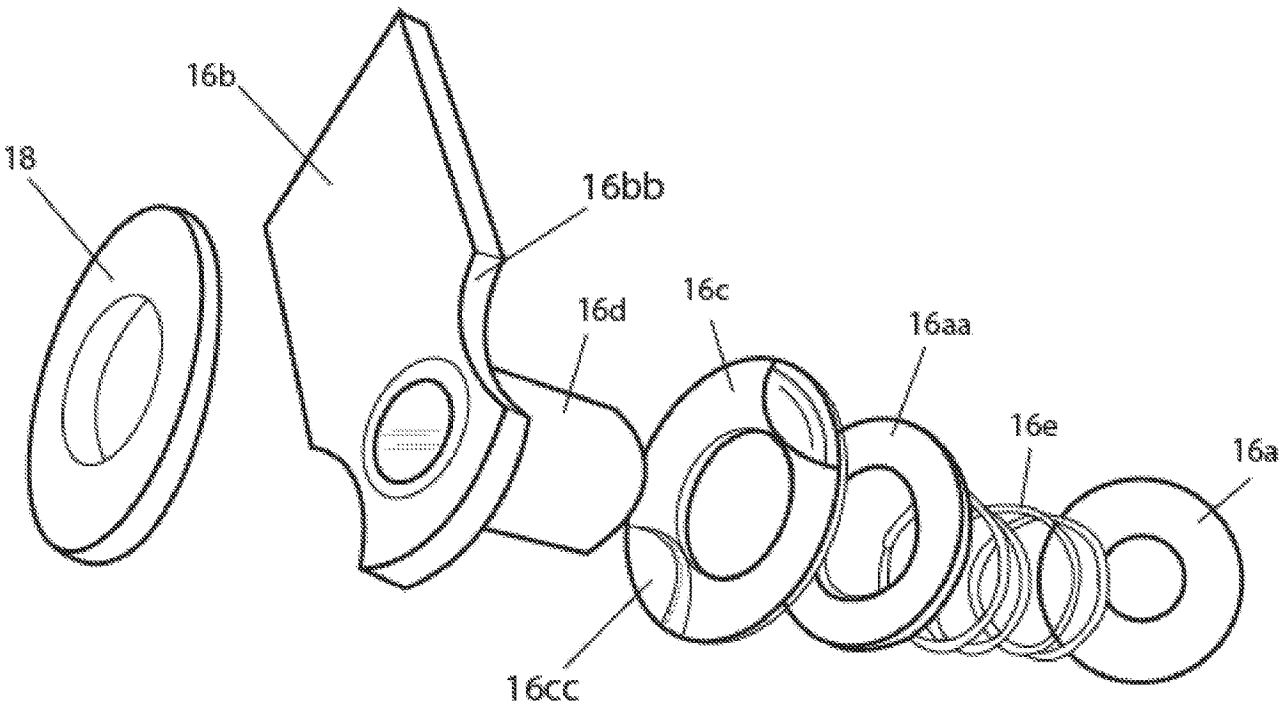
FIG. 4 is an exploded view of the paint scraper actuation mechanism used with the present invention.

Referring now to FIG. 4, the scraper blade 16*b* and operating mechanism is shown in an exploded view. In addition, magnet 18 is shown which is attached adjacent blade 16*b* which fits in a recess in paintbrush handle 12 body. A rigid cylindrical shaft 16*d* is attached and fixed to operating button 16*a* and its washer 16*aa* adjacent blade 16*b*. Spring 16*e* is actually positioned between operating button 16*a* and washer 16*aa* and the paintbrush handle recess holding the scraper blade 16*b* against the opposite side of the paintbrush handle. Since the blade 16*b* is firmly attached to cylindrical shaft 16*d* and operating button 16*a*, when button 16 is depressed toward the paintbrush handle, the blade will move away from the opposite side of the paintbrush handle, against the spring 16*e* tension, raising the blade above the locking washer 16*c* so that that blade 16*b* can rotate 180°. When the scraper blade mechanism is attached to the paintbrush handle 12 shown in FIGS. 1, 2 and FIGS. 3A and 3B, the operating button 16*a* and the washer 16*aa* are attached to one end of cylindrical shaft 16*d* and spring 16*e*, all of which are on one side of a paintbrush handle 12 and disposed in a recessed area in the paintbrush handle 12.

As can be appreciated when reviewing FIGS. 1-4, the user is provided with a paintbrush 10 having a specially designed handle 12 that is comfortable for painting because of recessed thumb area 12*c*, a paint scraper blade 16*b* that can be instantly deployed with brush in hand and a magnet 18 for hanging the brush 10 against the metal surface such as a paint can when the painting is finished.

The invention claimed is:

1. A paintbrush having brush bristles attached to a paintbrush handle, said paintbrush handle having a proximal end attached to said brush bristles and a distal end and an elongated body between the distal end and the proximal end;

a rotatable paint scraper attached to the distal end of said paintbrush handle;

said rotatable paint scraper including a paint scraper blade with locking slots, a shaft connected at one end to said blade;

an actuating button connected to said opposite end of said shaft; said shaft connected through a portion of said paintbrush distal end one side to the other side is mounted on the opposite side of said paintbrush handle;

a blade locking member connect to said distal end of said paintbrush handle on one side in engagement with said blade locking slots for locking the blade in position relative to the paintbrush handle; spring attached between said distal end of said paintbrush handle and said activating button and for holding said blade against said paint brush handle;

whereby said actuating button can be depressed against said spring causing the blade to be moved away from said paintbrush handle and said blade locking member allowing the blade to be rotated 180° from an operating position extending away from the distal end of said brush to a storage position 180° flush with said paintbrush handle.

2. A paintbrush as in claim 1, including:

a magnet attached to one end of said shaft for supporting said handle against the metal surface such as a paint can.

3. A Paintbrush as in claim 1, including:

said paintbrush handle elongated body portion including a shallow, elliptically-shaped recess, sized to receive a user's thumb to enhance the comfort of grasping said paintbrush handle.

* * * * *